US009914322B2

(12) United States Patent
Soejima

(10) Patent No.: US 9,914,322 B2
(45) Date of Patent: Mar. 13, 2018

(54) WRITING UTENSIL WITH RETRACT PIECE

(71) Applicant: ZEBRA CO., LTD., Tokyo (JP)

(72) Inventor: Eriko Soejima, Tokyo (JP)

(73) Assignee: ZEBRA CO., LTD., Tokyo (JP)

( * ) Notice: Subject to any disclaimer, the term of this patent is extended or adjusted under 35 U.S.C. 154(b) by 0 days.

(21) Appl. No.: 15/172,480

(22) Filed: Jun. 3, 2016

(65) Prior Publication Data

US 2016/0375715 A1 Dec. 29, 2016

(30) Foreign Application Priority Data

Jun. 25, 2015 (JP) ..... 2015-127396

(51) Int. Cl.
*B43K 7/12* (2006.01)
*B43K 24/03* (2006.01)
*B43K 21/04* (2006.01)

(52) U.S. Cl.
CPC ..... *B43K 24/03* (2013.01); *B43K 21/04* (2013.01)

(58) Field of Classification Search
CPC ..... B43K 21/04; B43K 21/006; B43K 21/16; B43K 21/20
USPC ..... 401/115
See application file for complete search history.

(56) References Cited

U.S. PATENT DOCUMENTS 2,757,639 A * 8/1956 Wichmann ..... B43K 24/03 401/112
5,997,203 A 12/1999 Wang

FOREIGN PATENT DOCUMENTS

JP 34-10370 11/1959

OTHER PUBLICATIONS

Office Action issued in Japan Counterpart Patent Appl. No. 2015-127396, dated Jul. 12, 2016, along with an English translation thereof.
Office Action issued in Japan Counterpart Patent Appl. No. 2015-127396, dated Oct. 18, 2016 , along with an English translation thereof.

* cited by examiner

*Primary Examiner* — Jennifer C Chiang
(74) *Attorney, Agent, or Firm* — Greenblum & Bernstein, P.L.C.

(57) ABSTRACT

A writing utensil with a retract piece is provided, with this writing utensil being equipped with a retract piece that is provided on one end side of a shaft tube of a writing utensil body and that goes forward and assumes a projecting state by its own weight when oriented to face downward, and goes backward and assumes a retracting state by its own weight when oriented to face upward, wherein the writing utensil includes: an advancing and retreating member including the retract piece on a front end side thereof and supported to advance/retreat relative to the writing utensil body; and rolling element supported to rotate without advancing/retreating relative to the writing utensil body, and an outer circumferential face of the rolling element contacts a side face of the advancing and retreating member.

4 Claims, 6 Drawing Sheets

WRITING UTENSIL WITH RETRACT PIECE

TECHNICAL FIELD

The present invention relates to a writing utensil equipped with a retract piece, such as an eraser, a writing part, or other types of retract pieces, on one end side of a writing utensil body.

RELATED ART

Typically, this type of invention relates to a writing utensil including a ballpoint pen refill in a shaft tube of a writing utensil body and configured such that when oriented to face downward, the ballpoint pen refill moves forward by its own weight and stops assuming a projecting state, and when oriented to face upward, the ballpoint pen refill in the stop state is released and moves backward by its own weight assuming a retracting state, as described in, Patent Document 1.

In this typical technique, when the ballpoint pen refill moves forward and assumes the projecting state, a ball (43) touching a rear end of the ballpoint pen refill stops at a step part of an inner shaft tube face (the inner face of a hollow body 29), and a wedge-shaped member having a conical head part (46) is pinched between the ball and the inner circumferential face of the shaft tube on the opposite side of the step part in a radial direction. Note that a number in parentheses indicates a reference numeral in Patent Document 1.

However, according to the above-described typical technique, when the ballpoint pen refill returns from the stop state, it might be difficult to detach the wedge-shaped member due to biting between the ball (43) and the inner shaft tube face, or unnecessary noise might be caused due to rattling of the ball (43) and the wedge-shaped member in the shaft tube, for example. For this reason, improvement in operability has been demanded.

CITATION LIST

Patent Documents

[Patent Document 1] Japanese Granted Patent No. S34-10370

SUMMARY OF THE INVENTION

The present invention has been made in view of the above-described typical situation, and is intended to provide a writing utensil with a retract piece, the writing utensil exhibiting improved operability when the retract piece retracts.

A solution to the above-described problem is a writing utensil with a retract piece, the writing utensil being equipped with a retract piece that is provided on one end side of a shaft tube of a writing utensil body and that moves forward and assumes a projecting state by its own weight when oriented to face downward, and moves backward and assumes a retracting state by its own weight when oriented to face upward, the writing utensil including: an advancing and retreating member including the retract piece on a front end side thereof and supported to advance/retreat relative to the writing utensil body; and a rolling element supported to rotate without advancing/retreating relative to the writing utensil body, wherein an outer circumferential face of the rolling element contacts a side face of the advancing and retreating member.

Since the present invention is configured as described above, operability can be improved when the retract piece retracts.

BRIEF DESCRIPTION OF THE DRAWINGS

FIG. 4A illustrates a retracting state right after the retract piece faces downward, and FIG. 4B illustrates the state in which the retract piece projects downward by forward movement of an advancing and retreating member;

FIG. 4C illustrates the state in the middle of moving rolling elements into recessed parts, and FIG. 4D illustrates the state in which each rolling element is fitted into a corresponding one of the recessed parts.

DETAILED DESCRIPTION OF PREFERRED EMBODIMENTS

Figure 1:
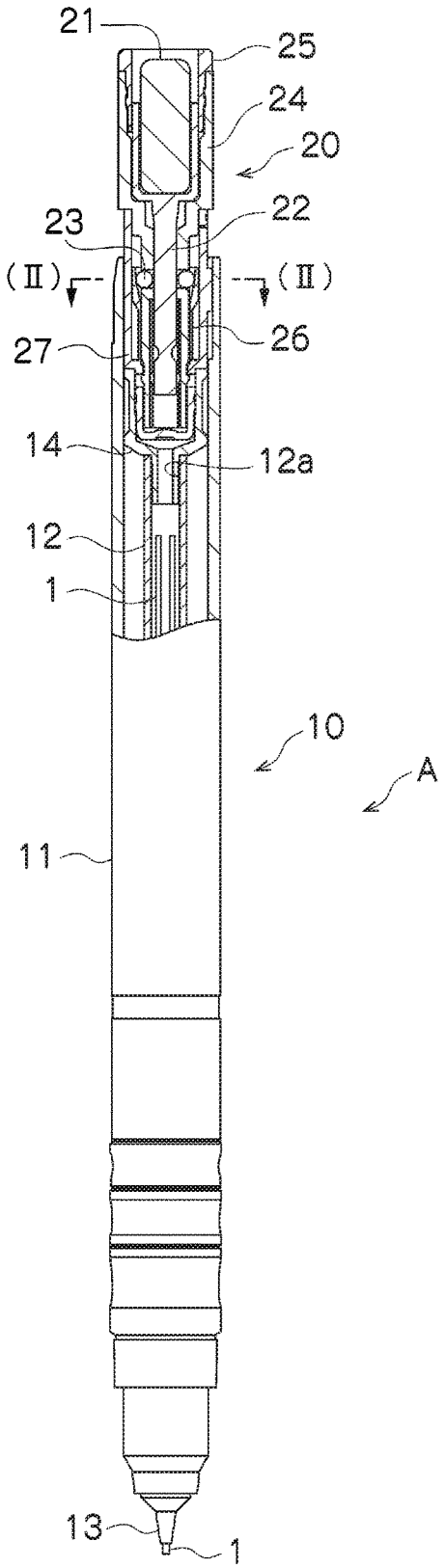
FIG. 1 is a partially-cutaway cross-sectional side view of an example of a writing utensil with a retract piece according to the present invention.

A first feature of the present embodiment is provided by a writing utensil with a retract piece, the writing utensil being equipped with a retract piece that is provided on one end side of a shaft tube of a writing utensil body and that moves forward and assumes a projecting state by its own weight when oriented to face downward, and moves backward and assumes a retracting state by its own weight when oriented to face upward, the writing utensil including: an advancing and retreating member including the retract piece on a front end side thereof and supported to advance/retreat relative to the writing utensil body; and a rolling element supported to rotate without advancing/retreating relative to the writing utensil body, wherein an outer circumferential face of the rolling element contacts a side face of the advancing and retreating member.

According to such a configuration, when the retract piece and the advancing and retreating member advance/retreat together, the side face of the advancing and retreating member contacts the outer circumferential face of the rolling element, and then, the rolling element rolls and rotates. This reduces the frictional resistance of the advancing and retreating member, and as a result, the advancing and retreating member can smoothly advances/retreats.

Note that the "retract piece" described above may retract on one end side of the shaft tube of the writing utensil body, and includes retract pieces having the above-described writing function (e.g., a writing tip end part) and retract pieces having other functions than writing (e.g., erasers).

Moreover, the writing utensil equipped with the retract piece and configured as described above is preferably equipped with the unit configured to stop the retract piece from moving backward in the projecting state. However, such a unit is not essential.

For example, when the retract piece is a light or a light emitter, the function of such a retract piece can be fulfilled without stopping the retract piece from moving backward in the projecting state. In addition, the configuration may be employed, in which the retract piece in the projecting state is hold by a hand.

In addition to the first feature, a second feature is provided by the writing utensil further including: a recessed part which is provided at the side face of the advancing and retreating member at a position close to a rear end thereof and into which the rolling element is fitable; and a catching and releasing member supported to advance/retreat relative to the writing utensil body on a rear side of the rolling element, wherein when moving forward, the catching and releasing member contacts the rolling element at a position further toward an outer side than a center part of the rolling element in a radial direction of the shaft tube, and when moving backward, the catching and releasing member moves apart from the rolling element toward the rear side.

According to such a configuration, when the retract piece faces downward, the advancing and retreating member moves forward by its own weight, and the catching and releasing member also moves forward to contact the rolling element at a position further toward an outer side than a center part of the rolling element in a radial direction of the shaft tube. Accordingly, the rolling element moves inward in the radial direction of the shaft tube, and then, is fitted into the recessed part. When the retract piece faces upward, the catching and releasing member moves backward. Thus, the rolling element is detached from the recessed part, and the advancing and retreating member and the retract piece move backward by their own weight.

In addition to the first or second feature, a third feature is, in order to further improve the operability, provided by the writing utensil further including a holder supporting, at the writing utensil body, the advancing and retreating member such that the advancing and retreating member advances/retreats, wherein the holder is provided with: a side wall covering and supporting a periphery of the advancing and retreating member such that the advancing and retreating member advances/retreats in order to retract/project the retract piece back and forth; and a through-hole penetrating the side wall in a thickness direction thereof, and the holder supports the rolling element such that the rolling element rotates without advancing/retreating relative to the writing utensil body in the through-hole.

In addition to any one of the first to third features, a fourth feature is, in order to further improve the operability, provided by the writing utensil, in which the rolling element is provided in plurality, the plurality of rolling elements being provided to pinch the advancing and retreating member to an inner side in the radial direction of the shaft tube.

In addition to any one of the first to fourth features, a fifth feature is, in order to further improve the operability, provided by the writing utensil, in which the catching and releasing member is formed in a tubular shape, into a center of which the holder is inserted, and an inner circumferential face of the catching and releasing member on a front end side thereof is provided with an inclined face touching, from the rear side, a part of the rolling element at a position close to an outer side in the radial direction of the shaft tube.

Note that the "to an outer side in the radial direction of the shaft tube" as described above means the direction apart from the center of the shaft tube along the radial direction thereof.

In addition to the fifth feature, a sixth feature is, in order to reduce the weight of the catching and releasing member to reduce operational failure due to, e.g., biting, provided by the writing utensil, in which the catching and releasing member is configured such that a diameter at an outer face of a circumferential wall on the rear side of the inclined face is reduced than that on a front side of the inclined face.

Note that "to an inner side in the radial direction of the shaft tube" as described above means the direction toward the center of the shaft tube along the radial direction thereof.

In addition to any one of the first to sixth features, a seventh feature is provided by the writing utensil, in which an integrated retract unit including the retract piece, the advancing and retreating member, and the rolling element and configured to retract the retract piece by its own weight is provided, and the retract unit is detachably attached to the writing utensil body.

In addition to the seventh feature, an eighth feature is provided by the writing utensil in which, the writing utensil body is a mechanical pencil with a lead tank, and the retract unit is detachably attached to an opposite end side to a tip side of the lead tank.

Embodiment

Next, a preferable embodiment with the above-described features will be described in detail with reference to drawings.

FIG. 1 illustrates an example of a writing utensil with a retract piece according to the present invention.

A writing utensil A with a retract piece 21 forms a mechanical pencil such that a retract unit 20 configured to retract the retract piece 21 by its own weight is detachably attached to an opposite end side of a tip side of a writing utensil body 10.

Note that in description of the writing utensil body 10 in the present specification, the direction (downward as viewed in FIG. 1) in which a lead 1 is pushed out is indicated as "tip" (a tip end, a tip side, etc.), and the opposite direction of the direction in which the lead 1 is pushed out is indicated as "opposite" (an opposite end, an opposite direction, etc.).

Moreover, in description of the retract unit 20, the direction (downward as viewed in FIG. 4) in which the retract piece 21 projects is indicated as "front" (a front end, a front side, etc.), and the opposite direction of the direction in which the retract piece 21 projects is indicated as "rear" (a rear end, a rear side, etc.).

The writing utensil body 10 is, in an elongated shaft tube 11, equipped with a lead tank 12 configured to house a plurality of leads 1, a lead push-out mechanism (not shown) configured to push the lead out of the lead tank 12 toward the tip side, and a slider 13 into which the lead pushed out of the lead push-out mechanism is inserted and which is configured to protect such a lead.

The shaft tube 11 is formed in a hollow elongated tubular shape. The slider 13 is inserted into a tip-side opening of the shaft tube 11, and the later-described retract unit 20 is inserted into an opposite end side opening 12*a* of the tip-side opening. The shaft tube 11 may be in the form of including a single tubular member or in the form of connecting a plurality of tubular members in an axial direction.

The lead tank 12 is an elongated tubular member opening at a tip end part and an opposite end part thereof. According to an illustrated example, the retract unit 20 is detachably connected to the opposite end side opening 12*a* through a connect member 14.

The connect member 14 is a member formed in a small-diameter tubular shape on the tip side and formed in a large-diameter tubular shape on the opposite end side.

The small-diameter tubular part is undetachably press-fitted into the opposite end side opening 12*a* of the lead tank 12. Moreover, the inner circumferential face of the large-diameter tubular part is provided with an annular recessed-raised part such that the retract unit 20 is detachably fitted over the recessed-raised part.

The lead push-out mechanism is a well-known mechanism configured to push out, toward the tip side, the lead 1 pinched by a chuck (not shown) connected to the tip side of the lead tank 12 by the knocking operation for the retract unit 20 connected to the opposite end side of the lead tank 12.

The lead push-out mechanism may be a mechanism configured to push out the lead 1 by the operation received from the outside. For example, the lead push-out mechanism may be replaced with a mechanism configured to push out the lead 1 by the operation of pushing a button provided on a shaft tube side face, a mechanism configured to push out the lead 1 by the operating of shaking the entirety of the shaft tube, or a mechanism configured to push out the lead 1 by the operation of rotating the opposite end side of the lead tank.

The slider 13 is a substantially tubular member, and the lead 1 pushed out of the lead push-out mechanism is inserted into the slider 13. The slider 13 has the lead protection function of moving forward, while an inclined cam face of an outer circumferential part of the slider 13 is sliding on the tip end edge of the shaft tube 11, to cover the lead 1 in reception of force from the lead 1 in the radial direction thereof.

Note that as other examples, the configuration of the slider 13 may be replaced with the configuration without the lead protection function, such as a slider having no inclined cam face or a lead insertion member fixed at the tip end of the shaft tube 11 not to advance and retreat.

Next, the retract unit 20 will be described in detail.

Figure 4A:
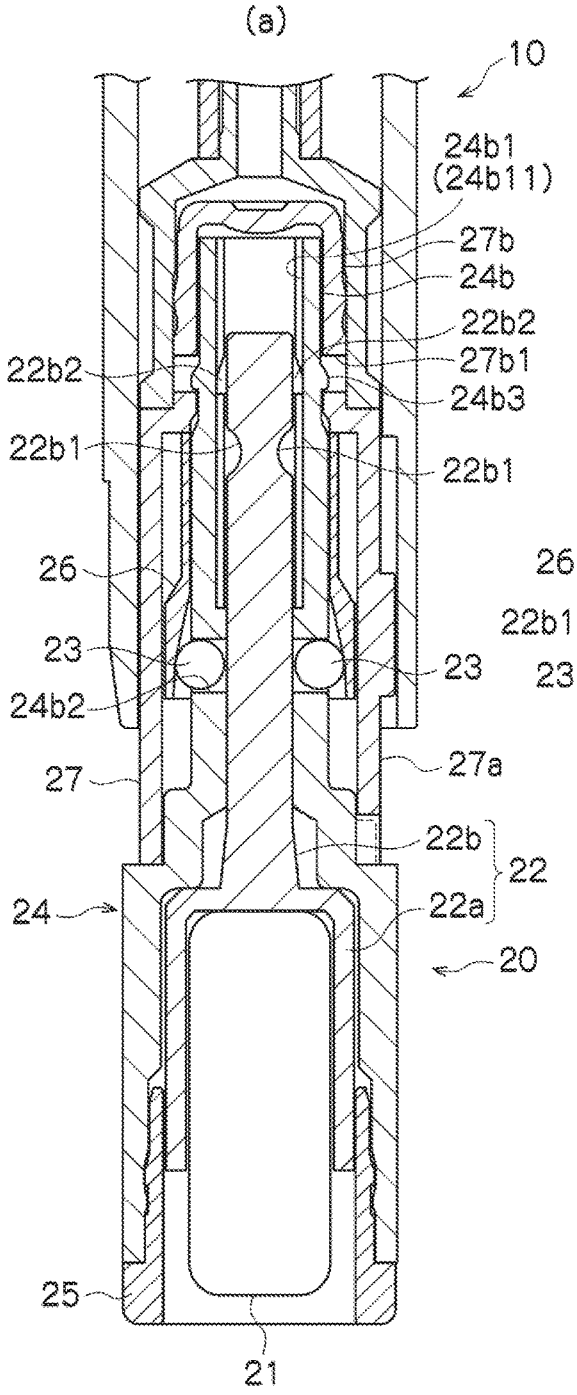
FIGS. 4A and 4B are partial cross-sectional views showing the operation of the writing utensil with the retract piece.

As illustrated in FIG. 4A, the retract unit 20 is equipped with an advancing and retreating member 22 connecting the retract piece 21 on the front end side and supported to advance/retreat relative to the writing utensil body 10, rolling elements 23 supported to rotate without advancing/retreating relative to the writing utensil body 10, a holder 24 supported by the writing utensil body 10 and supporting the advancing and retreating member 22 such that the advancing and retreating member 22 advances/retreats, a catching and releasing member 26 supported to advance/retreat relative to the writing utensil body 10 on the rear side of the rolling elements 23, a decorative ring 25 provided on the front end side of the holder 24, and a support case 27 supporting the holder 24 to cover the catching and releasing member 26 such that the catching and releasing member 26 advances/treats.

The retract piece 21 is a columnar eraser retracting into the holder 24 and the decorative ring 25.

The retract piece 21 is detachably fitted and fixed on the front end side of the advancing and retreating member 22. In the state (see FIG. 1) in which the front end side of the retract unit 20 faces upward, the retract piece 21 is housed in the holder 24 and the decorative ring 25.

The advancing and retreating member 22 includes a retainer 22*a* configured to detachably retain the retract piece 21, and a slide shaft 22*b* provided to extend from the rear end of the retainer 22*a* to the rear side (see FIG. 4A).

The retainer 22*a* is formed in such a tubular shape that the rear part side of the retract piece 21 can be inserted into the retainer 22*a*, and the inner circumferential wall face of the retainer 22*a* is in press-contact with the outer circumferential face of the retract piece 21.

Figure 2:
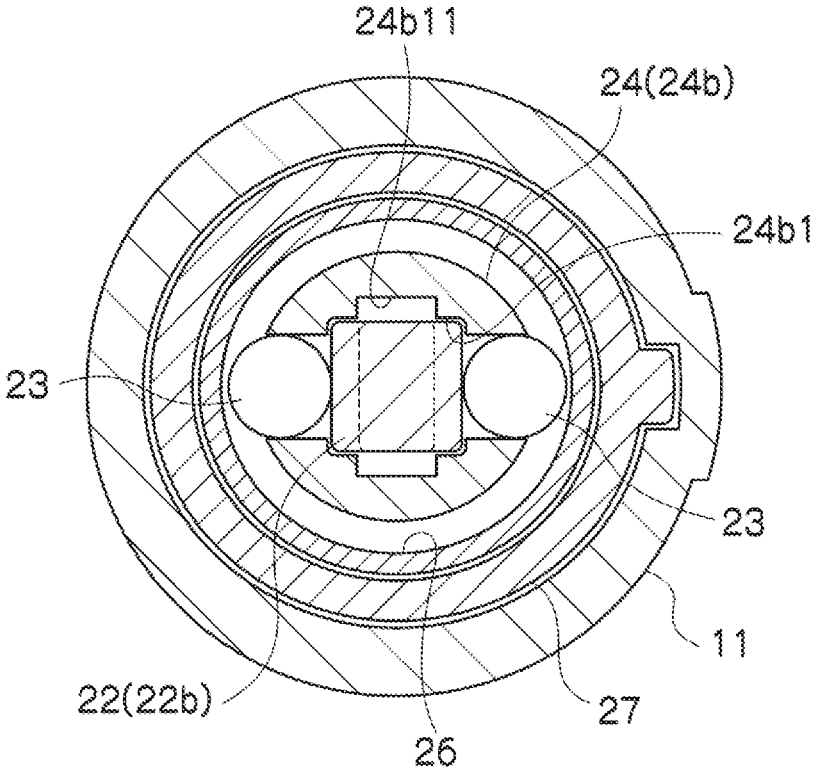
FIG. 2 is an enlarged cross-sectional view along an (II)-(II) line of FIG. 1.

The slide shaft 22*b* is formed in an elongated quadrangular prism shape (see FIG. 2). Two recessed parts 22*b*1 are provided close to the rear end at the slide shaft 22*b*. These recessed parts 22*b*1 are positioned respectively at both side faces of the slide shaft 22*b*. Each recessed part 22*b*1 is formed to have such a substantially-arc cross section that the rolling element 23 is fitable into the recessed part 22*b*1.

Moreover, restriction raised parts 22*b*2 configured to restrict the advancing and retreating member 22 from sliding forward are provided at both side faces of the slide shaft 22*b* on the rear side of the recessed parts 22*b*1.

Each rolling element 23 is a spherical member made of, e.g., metal or a hard resin material. The plurality of rolling elements 23 (two in the illustrated example) are arranged to inwardly pinch the slide shaft 22*b* of the advancing and retreating member 22 in the radial direction of the shaft tube. Each rolling element 23 is provided to freely rotate in a corresponding one of later-described through-holes 24*b*2 of the holder 24.

Figure 4B:
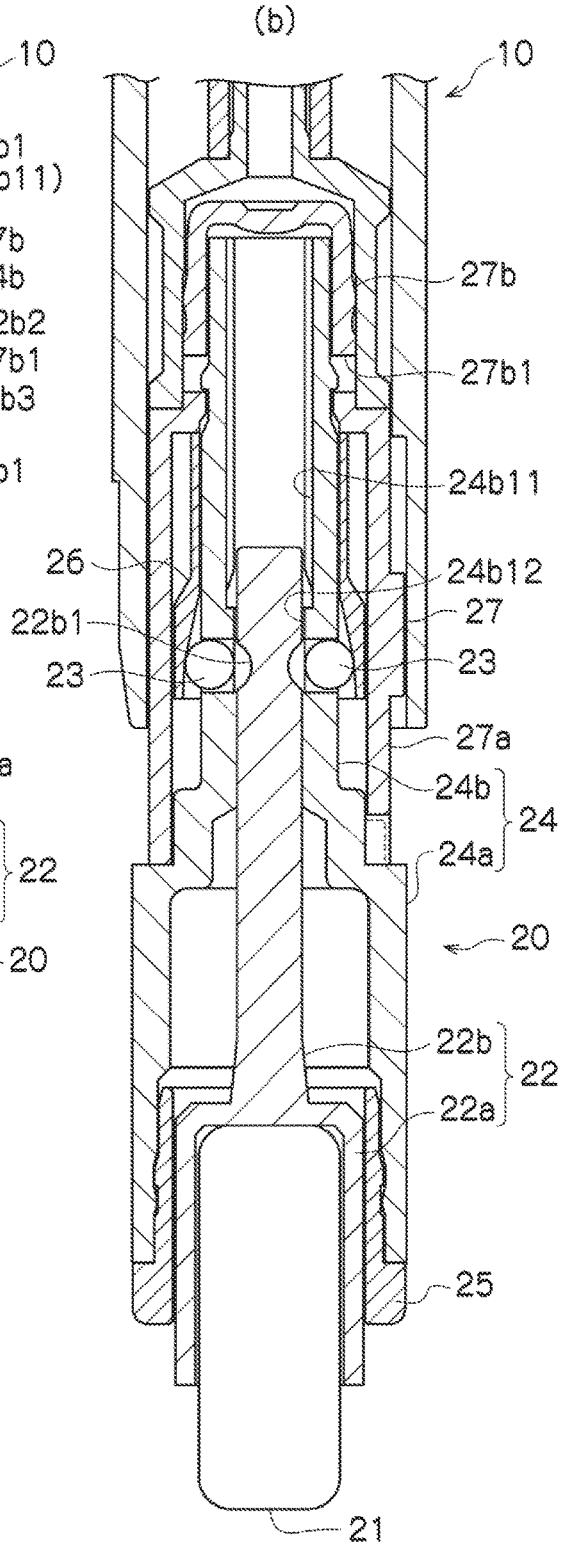

The holder 24 is equipped with a tubular cover wall 24*a* configured to cover the periphery of the retract piece 21 and the retainer 22*a* of the advancing and retreating member 22 and with a slide support 24*b* extending from the rear end of the cover wall 24*a* to the rear side to slidably support the advancing and retreating member 22 (see FIG. 4B).

The cover wall 24*a* is formed in a tubular shape covering the retainer 22*a* of the advancing and retreating member 22 with a clearance being formed around the retainer 22*a*, and the tubular decorative ring 25 is fitted and fixed on the front end side of the cover wall 24*a*. Note that as another example, the decorative ring 25 can be omitted.

The slide support 24*b* is a shaft-shaped hollow member, and at the center thereof, is provided with a rectangular tubular slide hole 24*b*1 covering the periphery of the slide shaft 22*b* to slidably support the slide shaft 22*b* (see FIG. 2). At the inner face of the slide hole 24*b*1, guide grooves 24*b*11 each configured to guide, in the front-rear direction, a corresponding one of the restriction raised parts 22*b*2 on the rear end side of the advancing and retreating member 22 and inwardly-raised parts 24*b*12 configured to restrict forward movement of the slide shaft 22*b* are provided, for example.

A side wall part of the slide support 24*b* close to the front end is provided with the through-holes 24*b*2 (see FIG. 4A) penetrating such a side wall part in the thickness direction thereof. Each through-hole 24*b*2 is a hole having an inner diameter slightly larger than the outer diameter of the rolling element 23, and embraces the rolling element 23 such that the rolling element 23 freely rotates without advancing/retreating in the axial direction of the shaft tube.

Moreover, a side wall part of the slide support 24*b* close to the rear end is provided with protrusions 24*b*3 each projecting outward in the radial direction of the shaft tube to engage with a corresponding one of locking holes 27*b*1 of the support case 27.

The catching and releasing member 26 is formed in a tubular shape into which the slide support 24*b* of the holder 24 is inserted. In more detail, the catching and releasing member 26 includes a large-diameter part 26*a* positioned on the front side, and a small-diameter part 26*b* positioned on the rear side of the large-diameter part 26*a*, as illustrated in FIG. 3.

The large-diameter part 26*a* is formed such that the outer face thereof is near the inner circumferential face of the support case 27 described later.

At the inner circumferential face of the large-diameter part 26*a*, an annular inclined face is formed such that the diameter thereof gradually increases toward the front side.

Figure 3:
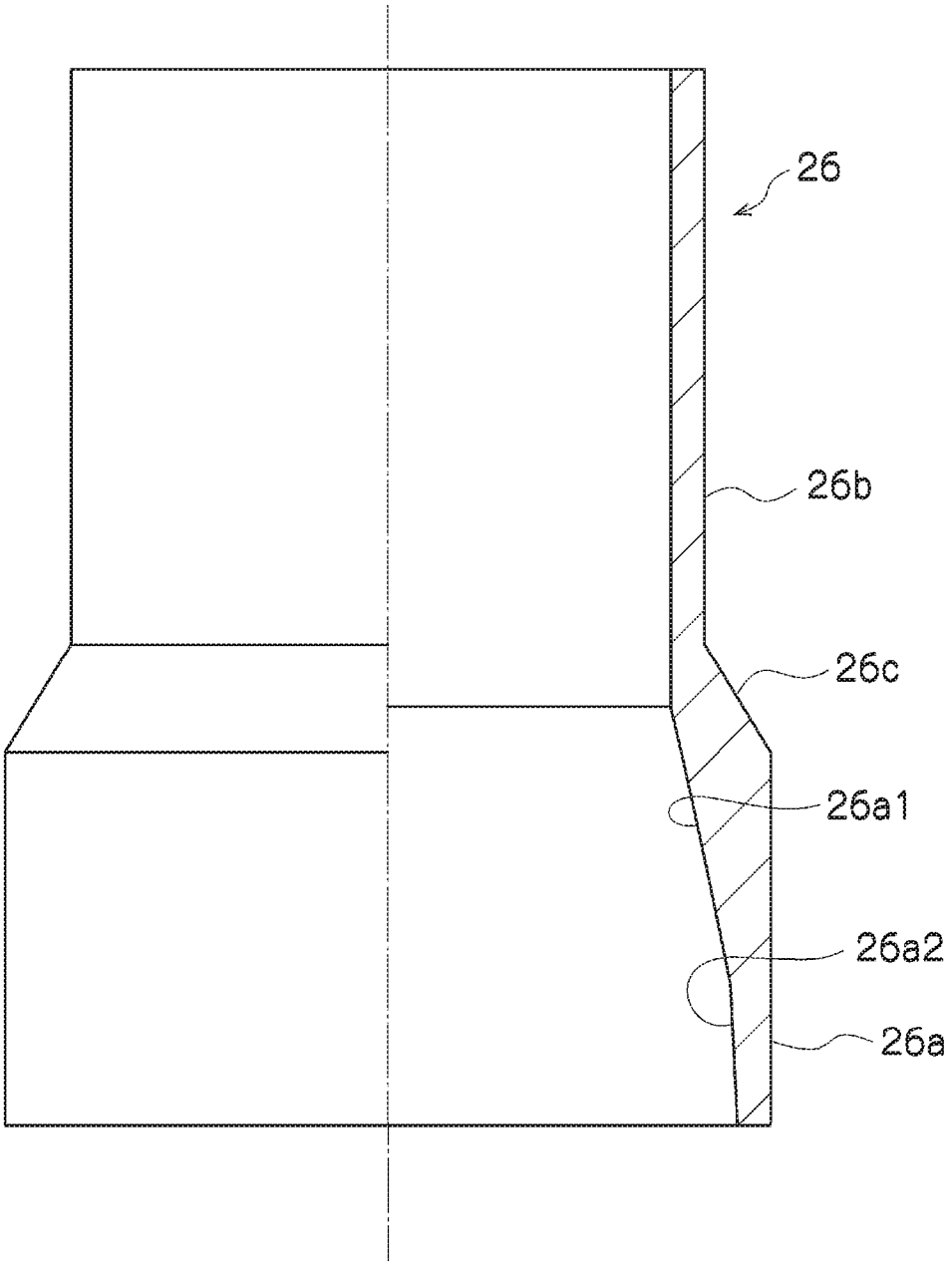
FIG. 3 is a half cross-sectional view of an example of a catching and releasing member.

According to an example illustrated in FIG. 3, such an inclined face includes a steeply-inclined face 26*a*1 whose inclination angle with respect to the center axis is relatively large, and a gently-inclined face 26*a*2 which is positioned on the front side of the steeply-inclined face 26*a*1 and whose inclination angle is smaller than that of the steeply-inclined face 26*a*1.

Moreover, the weight of the small-diameter part 26*b* is reduced in such a manner that the diameter at the outer circumferential face of the small-diameter part 26*b* on the rear side of the large-diameter part 26*a* is reduced as compared to the outer diameter of the large-diameter part 26*a*. The small-diameter part 26*b* is formed to slidably contact the outer circumferential face of the holder 24 on the rear side.

The outer circumferential faces of the small-diameter part 26*b* and the large-diameter part 26*a* are connected together through an annular inclined face 26*c* whose diameter is reduced toward the rear side.

According to the configuration of the catching and releasing member 26 as described above, when the retract piece 21 faces downward (see FIG. 4A), a favorable operability of the advancing and retreating member 22 can be exhibited. That is, if the catching and releasing member 26 has a relatively-great weight, each rolling element 23 might be tightly pinched between the inner circumferential face of the catching and releasing member 26 on the front end side and the slide shaft 22*b* of the advancing and retreating member 22, leading to resistance to forward movement of the advancing and retreating member 22. However, such a disadvantage can be solved in the present embodiment.

The support case 27 is a tubular member having a closed end on the rear end side. The support case 27 includes a tubular part 27*a* covering the catching and releasing member 26 such that the catching and releasing member 26 freely advances/retreats, and a detachable part 27*b* positioned on the rear side of the tubular part 27*a* and being detachable from the connect member 14 press-fitted into the rear end of the lead tank 12 (see FIGS. 4A and 4B).

The tubular part 27*a* has an inner diameter slightly larger than the maximum diameter of the catching and releasing member 26. A tubular space in which the catching and releasing member 26 slides in the front-rear direction by a predetermined distance is ensured between the tubular part 27*a* and the outer circumferential face of the slide support 24*b*.

The detachable part 27*b* is formed in a tubular shape having a closed end at the rear end. The detachable part 27*b* is, at the inner circumferential face thereof, fitted onto the holder 24 such that a rear end part of the holder 24 does not advance/retreat and rotate, and is, at the outer circumferential face thereof, detachably fitted into the connect member 14.

According to the illustrated example, the unit configured to detachably connect the detachable part 27*b* to the connect member 14 is the unit configured to detachably fit the detachable part 27*b* over the recessed-raised part. Other examples include connection using a screw(s) or other detachable structures.

Next, the characteristic features and advantageous effects of the writing utensil A equipped with the retract piece and configured as described above will be described.

As illustrated in FIG. 1, in the initial state in which the retract piece 21 faces upward, the retract piece 21 retracts into the holder 24 and the decorative ring 25, and cannot be visually observed from the side.

When the retract piece 21 of the writing utensil A faces downward from the initial state, the advancing and retreating member 22 slides downward as illustrated in FIGS. 4A, 4B, 4C, and 4D. In sliding, the rolling elements 23 roll along the slide shaft 22*b* of the advancing and retreating member 22. This allows the advancing and retreating member 22 to smoothly and linearly move forward, and resistance in such forward movement is less exhibited.

Then, when the advancing and retreating member 22 has slid to the front end of the advancing/retreating region, the recessed parts 22*b*1 of the advancing and retreating member 22 on the rear end side are positioned on the substantially-center line of the through-holes 24*b*2, as illustrated in FIG. 4B.

Figure 4C:
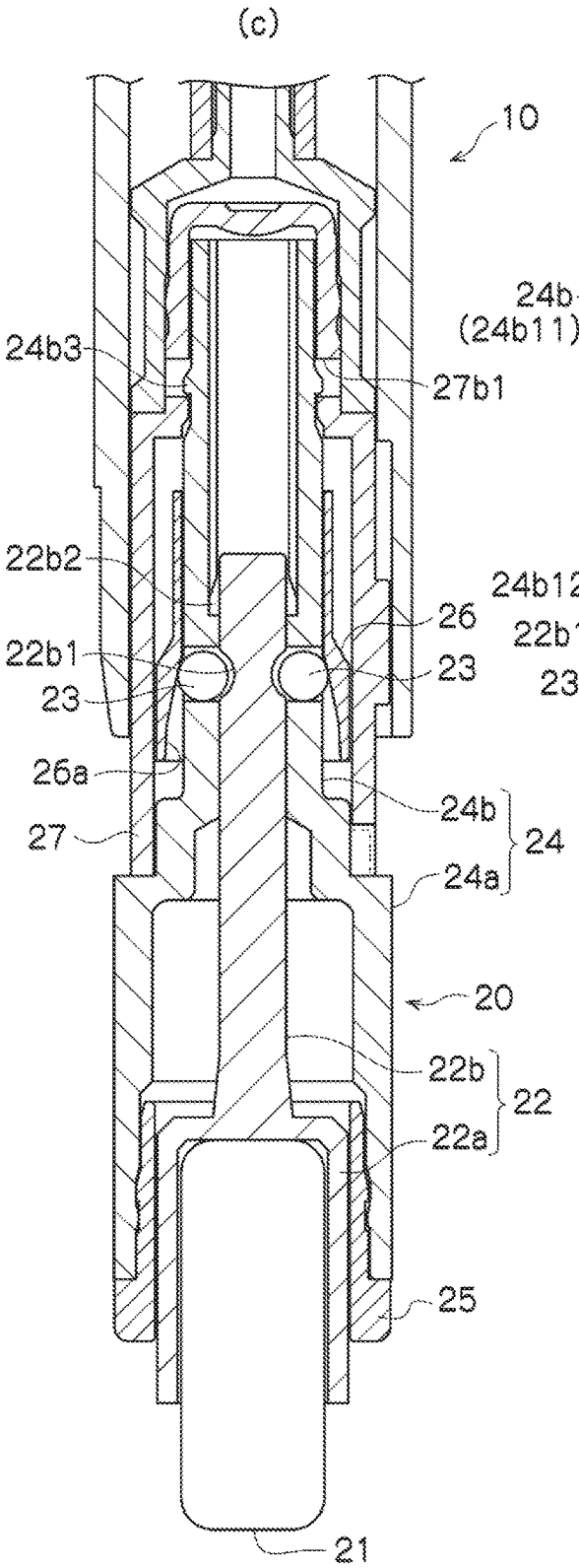
FIGS. 4C and 4D are partial cross-sectional views showing the operation of the writing utensil with the retract piece.
Figure 4D:
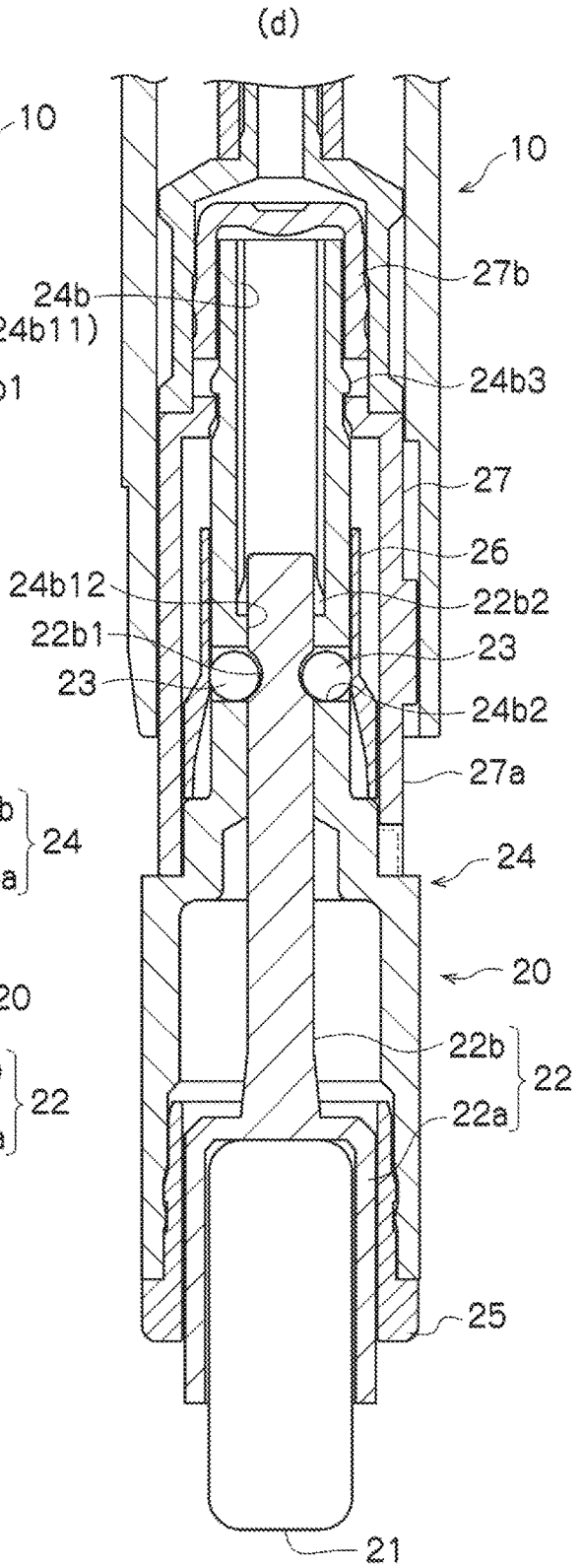

Meanwhile, the catching and releasing member 26 follows sliding of the advancing and retreating member 22 to slide downward (see FIG. 4C). Accordingly, the rolling elements 23 are pressed against the inner face of the catching and releasing member 26 on the front end side to move inward in the radial direction of the shaft tube. Then, each rolling element 23 is fitted into a corresponding one of the recessed parts 22*b*1 to bridge between the holder 24 and the advancing and retreating member 22.

Thus, in the state in which the retract piece 21 projects downward from the decorative ring 25, the advancing and retreating member 22 is stopped not to move backward.

When the retract piece 21 of the writing utensil A faces upward from the projecting state, the retract piece 21 retracts in the order opposite to that described above.

That is, the catching and releasing member 26 first moves backward. Next, the rolling elements 23 are pressed against the recessed curved faces of the recessed parts 22*b*1, and then, move to the outside of the recessed parts 22*b*1. Accordingly, the advancing and retreating member 22 in the stop state is released, and moves backward. Such backward movement allows the retract piece 21 to retract into the holder 24 and the decorative ring 25.

Thus, according to the writing utensil A equipped with the retract piece and configured as described above, when the retract piece 21 retracts, the advancing and retreating member 22 exhibits a high performance of moving straight and less resistance. Thus, e.g., biting of the catching and releasing member 26 is less caused. Moreover, noise due to movement of each component is not caused. As a result, a favorable operability can be exhibited.

In the state in which the retract piece 21 is stopped in the projecting state, when a backward load acts on the retract piece 21, such a load can be dispersed by the plurality of rolling elements 23. Thus, the strength of stopping the retract piece 21 in the projecting state can be improved, and the durability, reliability, etc. of the writing utensil A with the retract piece can be improved.

Figure 5:
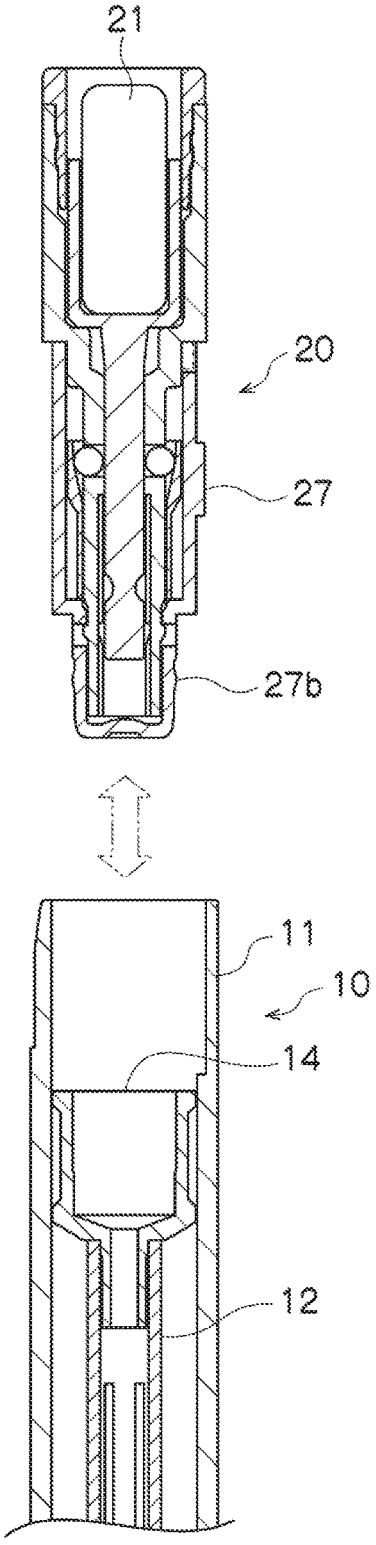
FIG. 5 is a partial cross-sectional view showing a state in which a retract unit is detached from the writing utensil body.

The retract unit 20 having the above-described configuration is, as illustrated in FIG. 5, easily detachable from the writing utensil body 10, easy detachment including, e.g., insertion and fitting into the connect member 14 on the opposite end side of the lead tank 12 and pulling and removal from the connect member 14.

Needless to say, replacement of the retract piece 21 due to, for example, consumption or damage thereof is facilitated, and the retract piece 21, the retract unit 20, etc. can be easily replaced with a piece, a unit, etc. having different colors, designs, functions, etc.

Various types of writing utensils A with retract pieces can be provided.

Note that according to the above-described embodiment, the spherical rolling element 23 has been described as a particularly-preferred form. However, other examples of the rolling element 23 include a columnar roller-shaped member and rolling elements in other shapes.

According to the above-described embodiment, two rolling elements 23 are provided as a particularly-preferred configuration. However, other examples include a configuration of providing a single rolling element 23 or three or more rolling elements 23.

According to the above-described embodiment, the retract piece 21 has been described as the eraser. However, other examples of the retract piece 21 include tip end parts of writing utensils (ballpoint pens, felt-tipped pens, mechanical pencils, correction pens, brush pencils, crayons, etc.), styluses, stamps, antistatic members, lights, light emitters, and USB memories.

According to the above-described embodiment, the writing utensil body 10 has been described as the mechanical pencil. However, other examples of the writing utensil body 10 include ballpoint pens, fountain pens, felt-tipped pens, marker pens, brush-tip pens, multifunctional writing utensils, and styluses.

REFERENCE SIGNS LIST

10: writing utensil body
11: shaft tube
12: lead tank
14: connect member
20: retract unit
21: retract piece
22: advancing and retreating member
**22*b*1**: recessed part
23: rolling element
24: holder
**24*b*2**: through-hole
25: decorative ring
26: catching and releasing member
**26*a*1**: steeply-inclined face
**26*a*2**: gently-inclined face
27: support case
A: writing utensil with retract piece

What is claimed is:

1. A writing utensil with a retract piece, the retract piece provided on one end side of a shaft tube of a writing utensil body, the retract piece moves forward and assumes a projected state due to its own weight when oriented downwardly, and moves backward and assumes a retracted state due to its own weight when oriented upwardly, the writing utensil comprising:

an advancing and retreating member including the retract piece on a front end side thereof and supported to advance/retreat relative to the writing utensil body;

a rolling element supported to rotate without advancing/retreating relative to the writing utensil body, a recessed part which is provide at the side face of the advancing and retreating member at a position close to a rear end thereof and into which the rolling element is fitable;

a catching and releasing member supported to advance/retreat relative to the writing utensil body on a rear side of the rolling element; and a holder supporting, at the writing utensil body, the advancing and retreating member such that the advancing and retreating member advances/retreats, wherein a circumferential face of the rolling element contacts a side face of the advancing and retreating member wherein when moving forward, the catching and releasing member contacts the rolling element at a position further toward an outer side than a center part of the rolling element in a radial direction of the shaft tube, and when moving backward, the catching and releasing member moves away from the rolling element toward the rear side, wherein the holder is provided with: a side wall covering and supporting a periphery of the advancing and retreating member such that the advancing and retreating member advances/retreats in order to retract/project the retract piece back and forth; and a through-hole penetrating the side wall in a thickness direction thereof, wherein the holder supports the rolling element such that the rolling element rotates without advancing/retreating relative to the writing utensil body in the through-hole, wherein the rolling element comprise a plurality of rolling elements, the plurality of rolling elements being provided to pinch the advancing and retreating member to an inner side, in the radial direction of the shaft tube, wherein the catching and releasing member has a tubular shape, the holder positioned at a center of the catching and releasing member, and wherein an inner circumferential face of the catching and releasing member, on a front end side thereof, is provided with an inclined face touching, from the rear side, a part of the rolling element at a position close to an outer side, in the radial direction of the shaft tube.

2. The writing utensil with the retract piece according to claim 1, wherein the catching and releasing member is configured such that a diameter at an outer face of a circumferential wall on the rear side of the inclined face is smaller than a diameter on a front side of the inclined face.

3. The writing utensil with the retract piece according to claims 1 or 2, in which an integrated retract unit, including the retract piece, the advancing and retreating member, and the rolling element is provided, and is configured to retract the retract piece by its own weight, and the retreat unit is detachably attached to the writing utensil body.

4. The writing utensil with the retract piece according to claim 3, wherein the writing utensil body is a mechanical pencil with a lead tank, and the retract unit is detachably attached to an opposite end side to a tip side of the lead tank.

* * * * *